US005315910A

United States Patent [19]

Soupios

[11] Patent Number: 5,315,910

[45] Date of Patent: May 31, 1994

[54] DETACHABLE RETROFIT FOR A GUITAR-TYPE MUSICAL INSTRUMENT

[76] Inventor: Charles C. Soupios, 93 Arleigh Rd., Great Neck, N.Y. 11021

[21] Appl. No.: 844,306

[22] Filed: Mar. 2, 1992

[51] Int. Cl.[5] ..... G10D 1/00

[52] U.S. Cl. ..... 84/453; 84/263; 84/291; 84/327

[58] Field of Search ..... 84/327, 263, 267, 268, 84/269, 291, 293, 453

[56] References Cited

U.S. PATENT DOCUMENTS 5,212,329 5/1993 Woodworth ..... 84/263

*Primary Examiner*—Michael L. Gellner
*Assistant Examiner*—Cassandra C. Spyrou

[57] ABSTRACT

An external support system that connects an electric guitar module (90), such as a travel guitar, to a standard electric guitar (80) or bass by detachably anchoring a linear holding device (20) to the standard instrument's body. The holding device (20) causes no alterations of the standard instrument, attaching to a posterior strap-fastening anchor (84) and an anterior horn-shaped curvature (86) to provide a slideable locking means (54) which fastens the external module (90).

4 Claims, 7 Drawing Sheets

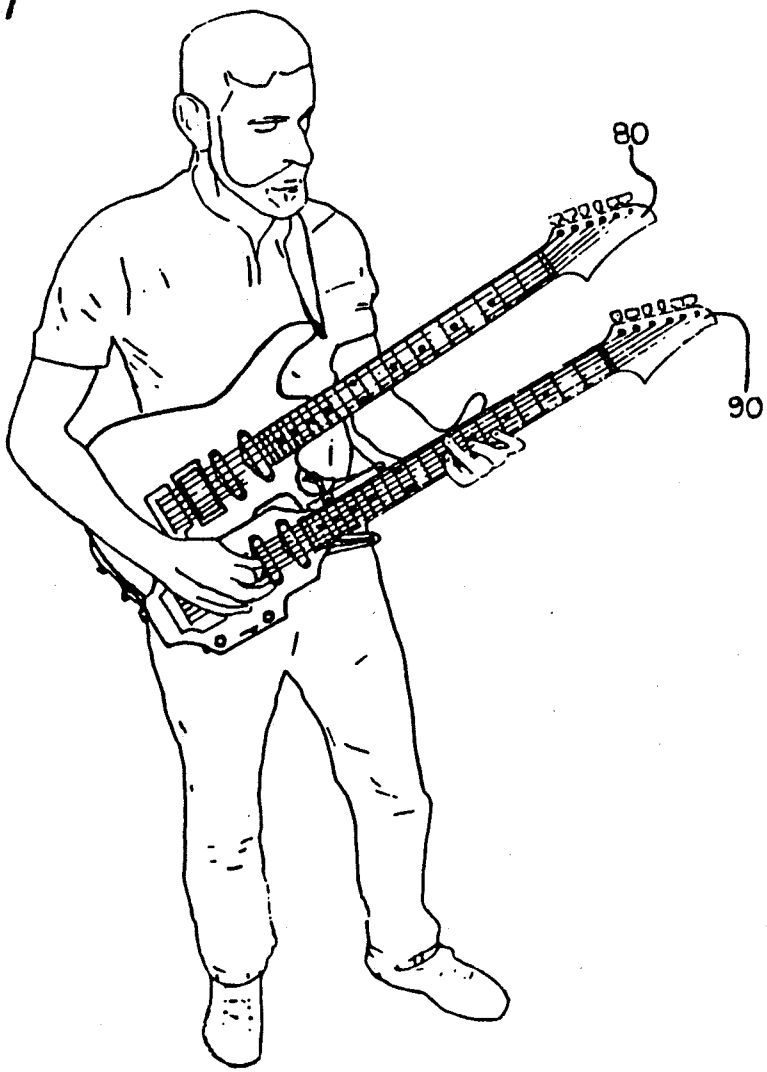
FIG. 1
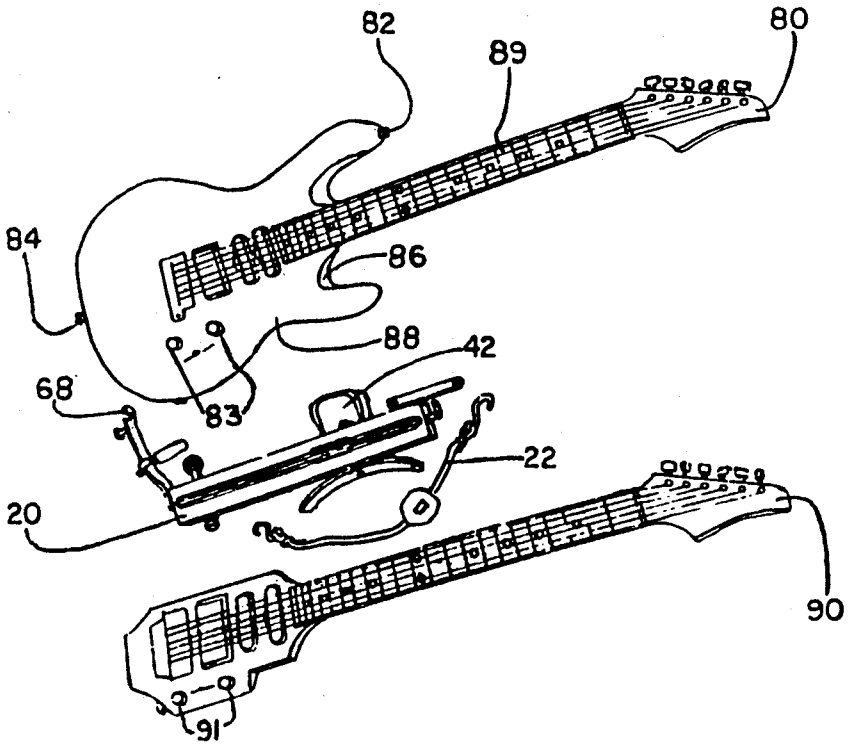

DETACHABLE RETROFIT FOR A GUITAR-TYPE MUSICAL INSTRUMENT

FIELD OF INVENTION

This invention relates to accessories for electric guitars, specifically to a device that securely attaches a small-bodied electric guitar to the face of a standard electric guitar or bass without altering the standard instrument, thereby creating a double-neck instrument of greater musical potentials.

BACKGROUND OF THE INVENTION AND DESCRIPTION OF PRIOR ART

Accessorized guitar technology has yielded more new developments than any other field in the domain of stringed musical instruments. Its popularity derives from a conservative nature among quitarists who choose to enhance their preferred instruments rather than adapt to newer models. This factor has often limited the scope of new research, placing more emphasis on accessorizing prior designs than on creating new ones. It may also be one of the most important considerations in further developing double-neck or combined instrument technologies.

Musicans seeking greater versatility in electric guitars have often found double-neck guitars to be problematic because of their weight and lack of balance. Many also dislike putting aside a favored single-neck instrument to use a double-neck when it is needed. Since most double-neck guitars have not offered enough variety to forego changing instruments altogether, some musicians choose to ignore them completely, opting instead to alternate more single-neck instruments. Unfortunately, having to carry several instruments to each venue is difficult, and it is nearly impossible to switch guitars without interrupting a musical part.

In lieu of double-neck technology, many have tried alternative approaches to achieving greater versatility. One concept involved keeping several instruments in readily playable positions on specially adapted stands as proposed in U.S. Pat. No. 2,547,924 to Citro (1951), and U.S. Pat. No. 4,742,751 to Cherry (1988) . The main problem was that a performer's movements were restricted to the location of the second instrument. Also it was difficult to reach around a guitar placed on one's shoulder to play another guitar on a stand. Furthermore, the additional setup time required for such applications made this option seem impractical.

As secondary electric instruments, travel guitars sparked an interest in small-bodied, portable designs that could be used for practicing almost anywhere. They were small enough to require less storage space and light enough to be combined with other instruments. Although many could sound like full-bodied guitars, their awkward balance and feeling were not usually acceptable for use on stage. This probably made the combined use of two travel guitars in a double-neck format seem undesireable. A logical development might have accessorized a full-bodied guitar with a high-quality travel guitar in the creation of a double-neck.

The first known method of accessorizing an acoustic guitar for the purpose of creating a double-neck capability was documented in U.S. Pat. No. 832,157 to Platts (1906). An invention in the form of a modular, stringed mandolin neck was clamped on to an acoustic guitar's upper curvature where it could vibrate the guitar's surface to create sounds. Unfortunately, attaching a larger, heavier guitar module with clamps could damage an acoustic guitar. A double-neck of U.S. Pat No. 4,987,815 to Shockley (1991) seemed to remedy this situation by making both instruments integral, but this also meant they were no longer detachable.

Some guitar modules looked like travel guitars, but they were interchangeable with separate, external bodies. Single-neck systems offered only as much versatility as could be gained by changing standard instruments. Modular double-necks, as described in U.S. Pat. No. 3,130,625 to Savona (1964) and U.S. Pat. No. 4,785,705 to Patterson (1988), offered more options. Generally, however, the use of modules rarely emulated fully integrated guitars. Also, these configurations could not accessorize standard instruments. Savona used rails for attachment, and Patterson used flexible straps that could risk collision between a module and a standard guitar.

Usually only pianos and floor harps were associated with the independent use of two hands to create separate melodic lines; however, similar two-hand methods were developed for guitar by players like Mark Laughlin and Jimmie Webster in the 1950's. Webster also published a book called, *Touch System for Electric and Amplified Spanish Guitar* (1952, W. J. Smith, New York), which demonstrated basic two-hand approaches. To further enhance this art, double-neck instruments have been proposed, but few have pleased guitarists who use standard picking methods. Double-neck technology is expected to meet the needs of both styles, however.

To promote better balance and facilitate simultaneous two-hand play, I offered a Biaxe double-neck guitar of U.S. Pat. No. 4,240,319 (1980). This instrument combined a full-sized guitar with a longer, stick-form guitar module which was offset to provide more accessibility for two-hand methods and to distribute the guitar's weight more evenly. One problem I found, however, was that an elongated lower neck was not well-suited for many common playing styles. Although the stick-form guitar enhanced two-hand playing, standard picking and strumming required a shorter replacement neck which was rendered inaccessible by the offset position.

By late 1980 a new Biaxe included a means of accommodating different neck lengths, which Guitar Player magazine published an article about in May of 1982. It employed a modular body with rails to support two guitar modules which could slide and lock into different longitudinal positions. (Prior configurations only facilitated one position.) Also the rail system provided electronic connections between both modules and the body, making them integral so they could feel more like a complete instrument. Many ergonomic features and the overall versatility of this Biaxe design made it appear more accessible than other double-necks.

Unfortunately, even though the Biaxe modules were detachably integrated with the external body, their feeling and playability still seemed less familiar than many standard guitars. Also the rails of this design needed special electronics to avoid picking up radio frequencies and noise which might be amplified. As with Savonals rail system, any warpage of the wooden body caused by weather changes would impede the sliding feature. There was also a risk of gradually pulling the rails out of a wooden body by constantly replacing the modules. The only remedy would be to have the rails in a separate housing to avoid such damage.

A major commercial drawback to this track system was that it could not attach to standard guitars or basses without altering them. Ergonomic comfort and visual access required that the bulk of an external guitar module be attached to the lower portion of a standard guitar, spaced apart from its surface. This negated using clamps since their lower placement would weaken from the direct force of gravity. The alternative was to drill holes into an instrument's body through which two or more connecting bolts could support a rail housing. Most musicians would avoid this to retain the aesthetic and commercial value of their instruments.

All of the related inventions heretofore known suffer from a number of disadvantages:

(a) Stands and support devices hinder freedom of motion and require extra set-up time, as well as extra carriage space.

(b) Most prior art instruments were integrated with special features that standard guitars and basses could not utilize. For this reason, many new concepts were limited to these inventions.

(c) With the exception of Platts' mandolin, prior art instruments could not accessorize popular guitars without altering them. (Platts used clamps with questionable safety.)

(d) Clamps are ill-adapted for attaching electric guitar modules to standard instruments. Unlike Platts, mandolin, the bulk of an external guitar module is better suited for placement over the lower surface of a standard instrument. Gravity would have a stronger affect on clamps in this position, which could mean slippage and damage to a guitar.

(e) Most prior art instruments could not facilitate simultaneous two-hand play: Shockley's guitar was integrated for standard playing styles only; Savonal s rail system did not provide offset positions; and Patterson's flexible system did not offer enough stability for both necks to be used simultaneously.

(f) Flexible means of connection, as suggested by Patterson, could not facilitate playing two necks from a seated position.

(g) Flexible means of connecting an external module to a full-size, standard guitar or bass could not remain stable enough to prevent collisions between both necks during a performance.

(h) Integral rail systems could pull apart from their bodies after extended use.

(i) Rails can become jammed as the wooden bodies that support them change with weather conditions. Without exception the dimensions required for guitar modules to slide in any track system will change from even a slight warpage.

(j) None of the prior art instruments could retain the feeling of a full-bodied, single-neck electric guitar, which is desired by many guitarists.

My current invention employs a light-weight, detachable retrofit with a sliding lock to secure an external guitar module to a standard guitar. This system allows the feeling and playability of a commercial instrument to be retained without altering its features in any way. A four, six, or twelve string travel guitar can be adapted for attachment to the sliding lock, which changes position to accommodate different neck lengths for various playing styles and to maintain proper balance. Rather than develop a new instrument, this concept combines instruments that have already been proven and accepted by musicians.

OBJECTS AND ADVANTAGES

Accordingly, several objects and advantages of the present invention are:

(a) to provide a more cost-effective approach to achieving greater musical versatility by accessorizing a musician's own personal guitar or bass with another four, six, or twelve string instrument;

(b) to provide a double-neck capability to a standard, commercially available stringed instrument without altering the original feeling or aesthetics of that instrument in any way;

(c) to enhance capabilities of simultaneous two-hand play on a commercial stringed instrument by facilitiating attachment and offset positioning of an external guitar or bass module (or a travel guitar) so each hand can play its own respective neck;

(d) to provide a simple, detachable means of securing an external guitar module to a standard guitar that utilizes the standard instrument's strap-fastening anchors and horn-shaped cutaways for support, rather than a clamping system or screws;

(e) to create a self-balancing, double-neck instrument by placing an external module on a sliding lock which adjustably maintains a center of gravity from the base of a standard guitar;

(f) to avoid the necessity of carrying extra instruments, changing instruments on stage, and taking extra time to set-up;

(g) to provide a fully independent and detachable alternative to instruments that employ integral rail systems which can gradually pull apart from a guitar body through constant use, thereby causing damage;

(h) to avoid problems associated with rail systems attached to wooden bodies wherein humidity changes can impede the adjustable sliding feature required for balance and versatility.

(i) to provide an alternative to rail systems which require electronic enhancement to prevent noise;

(j) to provide a means of expanding the surface of a standard guitar or bass for the addition of external gear by extending the lower curvature of the instrument's mid-section to adjustably support an external module and brace a musician's leg.

BRIEF DESCRIPTION OF DRAWINGS

FIG. 1 shows a standard electric guitar, retrofit system, and electric guitar module separately, and together as a complete double-neck instrument.

Figure 2:
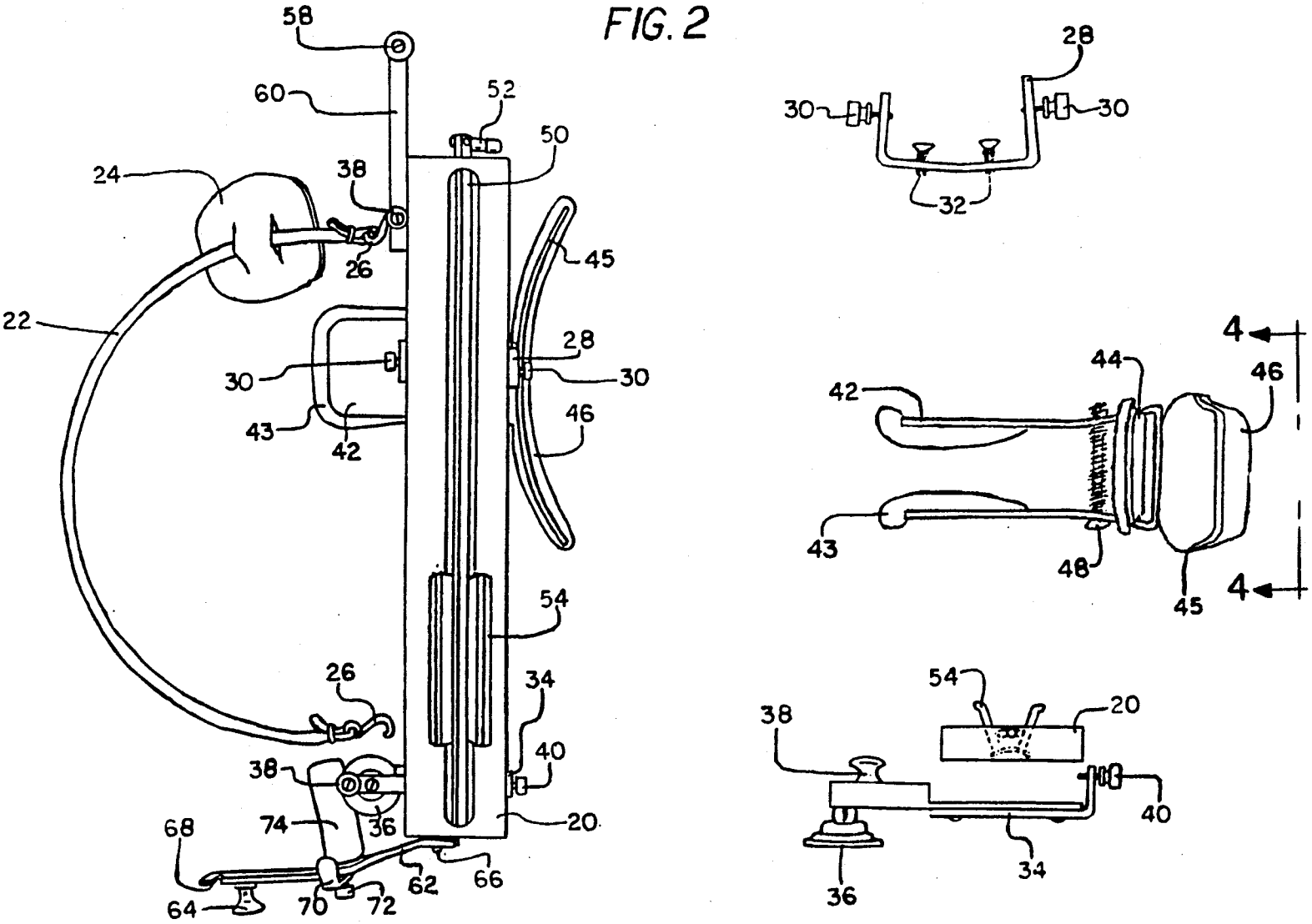
FIG. 2 shows a complete retrofit system with enlarged side views of a moveable support, curvature extension unit, and connecting receptacle.

| Reference Numerals in Drawings | |
|---|---|
| 20 retrofit encasement | 72 locking thumb screw |
| 22 bungee cord | 74 padding for cross-bar |
| 24 corner guard | 76 slotted backplate |
| 26 S-hook connectors | 79 standard guitar backplate |
| 28 connecting receptacle | 80 standard guitar |
| 30 thumb screws | 81 base member |
| 32 elevating screws | 82 anterior strap anchor |
| 34 moveable support device | 83 tone and volume (guitar) |
| 36 suction cup on screw | 84 posterior strap anchor |
| 38 bungee cord fastener | 85 guitar electronics cover |
| 40 thumb screw clamp | 86 horn-shaped cutaway |
| 42 curvature extension unit | 87 guitar output jack |
| 43 padding | 88 curved mid-section |
| 44 cushioned body expander | 89 neck |
| 45 leg brace | 90 external guitar module |
| 46 cushion | 91 tone and volume (module) |
| 48 clamping screw | 92 module electronics cover |
| 50 cam-shaft | 93 module output jack |
| 52 cam lever | 94 anterior stabilizing bar |
| 54 expanding plates | 95 new strap anchor holder |
| 56 flexible connector | 96 backplate with anchor |
| 58 spare strap anchor | 97 connecting bar |
| 60 spare strap anchor holder | 98 brace support |
| 62 stabilizing bar | 99 adjustable body brace |
| 64 replacement strap anchor | 100 security connector |
| 66 locking screw and channel | 101 new body expander |
| 68 keyhole slot | 102 adjusting receptacle |
| 70 slotted cross-bar | |

DETAILED DESCRIPTION OF FIGURES

A typical embodiment of the present invention is illustrated in FIG. 1 between a standard electric guitar 80 and an external guitar module 90, all of which are combined into a double-neck instrument. A bungee cord 22 secures both ends of a retrofit encasement 20 to the front of guitar 80 from around the back of the instrument. A keyhole slot 68 anchors the posterior of the system to a posterior strap-fastening anchor 84, and the bungee cord 22 braces a horn-shaped cutaway 86 for anterior support. (An anterior strap-fastening anchor 82 may instead be used on guitars that do not have a horn-shaped cutaway 86.) A curvature extension unit 42 attaches to a mid-section curvature 88 of the guitar 80 to adjustably stabilize and support the encasement 20. It can also be used to brace the leg of a seated musician. Each instrument has its own tone and volume control systems, 83 and 91 respectively, and a stringed neck 89 (designated on guitar 80).

FIG. 2 illustrates the entire retrofit system in detail with enlarged side-views of a connecting receptacle 28, a curvature extension unit 42, and a moveable support 34 which clamps to the retrofit encasement 20. All connecting parts, with the exception of the bungee cord 22, a corner guard 24, various padding (43, 46, 74), and a suction cup 36, can be made out of aluminum or a hard plastic of similar strength. (Screws are made of steel.) The main structure is the retrofit encasement 20, which houses a central cam-shaft 50 and two expanding plates 54. The cam-shaft lever 52 expands the plates 54 to secure the external module 90.

Most parts generally remain attached to the retrofit encasement 20, with the exception of the curvature extension unit 42, which holds a permanently attached connecting receptacle 28. This configuration braces a mid-section 88 of the guitar 80 before any other connections are made, stabilizing the entire system by expanding the surface of the guitar 80. A clamping screw 48 clamps two padded sections 43 onto the mid-section 88 to secure the unit 42. A cushioned body expander 44 (also in FIG. 4) extends a lower curvature of the guitar 80 in the form of a leg brace 45 to an appropriate distance from the guitar 80 for the connecting receptacle 28 to retain the system and the module 90.

A stabilizing bar 62 attaches to the system by means of a locking screw 66. As indicated earlier, the keyhole slot 68 on one end of this piece connects the posterior of the retrofit encasement 20 to the posterior strap-fastening anchor 84 of the guitar 80. A replacement strap-fastening anchor 64 is provided for use with a shoulder strap (not shown) . For added stability, a bent, slotted cross-bar 70 attaches to the stabilizing bar 62 by means of a thumb screw 72 to brace the end of the guitar 80 with a padded section 74. (See also FIG. 7.) Another thumb screw 40 clamps a moveable support 34 to the retrofit encasement 20 to elevate the entire system from the surface of the guitar 80 by means of soft contact from a threaded suction cup on a screw 36.

After the posterior connection is made, the anterior of the retrofit encasement 20 is placed in the connecting receptacle 28 on the curvature extension unit 42, which has already been clamped to the guitar 80. Two thumb screws 30 from the sides of the receptacle 28 secure the position of the encasement 20 against two elevating screws 32, which have been pre-adjusted to establish an appropriate anterior angle and lateral elevation from the surface of the guitar 80. The final step in installation extends the bungee cord 22 around the back of the guitar 80 with two Shooks 26 to attach to special fasteners 38 located on the moveable support 34 and on the spare strap anchor holder 60. A corner guard 24 protects the finish of the guitar 80.

Figure 4:
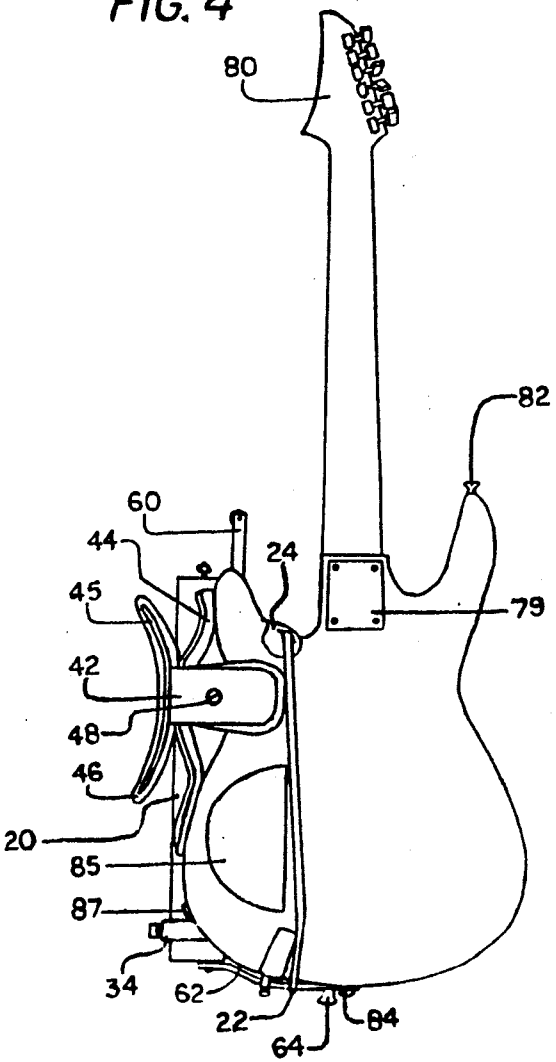
FIG. 4 shows the back of the standard guitar and placements of a security strap, corner guard, padded cross-bar, and back of the curvature extension unit.
Figure 3:
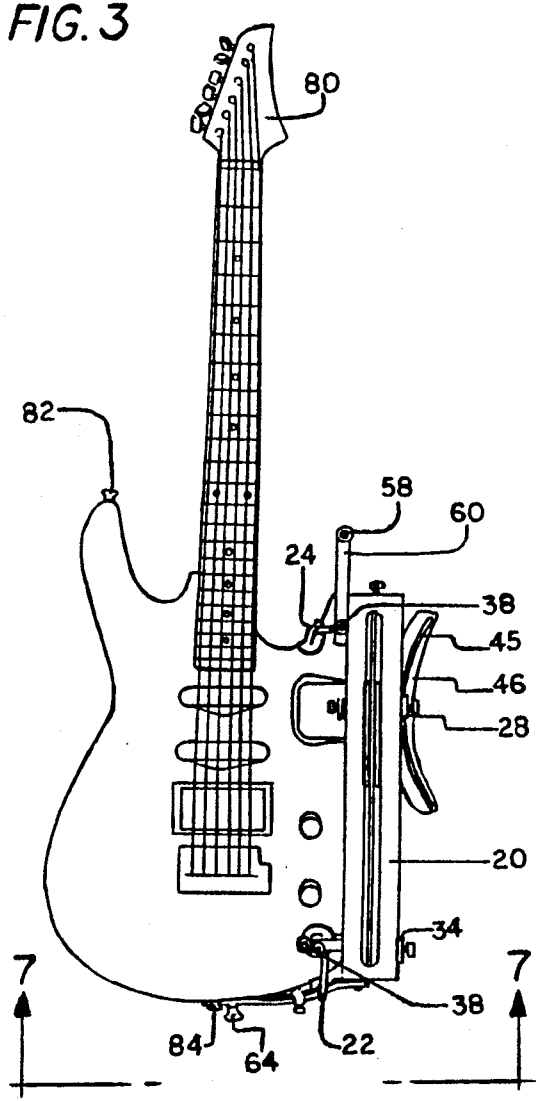
FIG. 3 shows a retrofit system attached to a standard electric guitar and placements of the holding device, curvature extension unit, and moveable support.

An installed retrofit system is illustrated in both FIGS. 3 and 4. The front view of FIG. 3 shows how the connecting receptacle 28 on the curvature extension unit 42 retains the anterior position of the retrofit encasement 20 at an appropriate distance from the playing area of the guitar 80. Also the moveable support 34 is shown contacting the face of the guitar 80 with the suction cup 36 while anchoring one Shook connector 26 of the bungee cord 22. These parts facilitate placement more than secure connection, however. Actual anchoring and support of the system depend on the facilities at the posterior strap-fastening anchor 84 and the horn-shaped cutaway 86 of the guitar 80.

The rear view of FIG. 4 shows how the cushioned body expander 44 extends the leg brace 45 and leg cushion 46 outward from the mid-section 88 of the guitar 80. This perspective of the clamping screw 48 also shows how the curvature extension unit 42 is attached. The placement of the corner guard 24 indicates that an overly taut bungee cord 22 might damage an instrument's finish in unprotected areas. This can be avoided, however, by readjusting the position of the moveable support 34 to loosen the bungee cord 22. Also shown are standard guitar features, including a backplate 79, an electronics cover 85, and an output jack 87.

Figure 5:
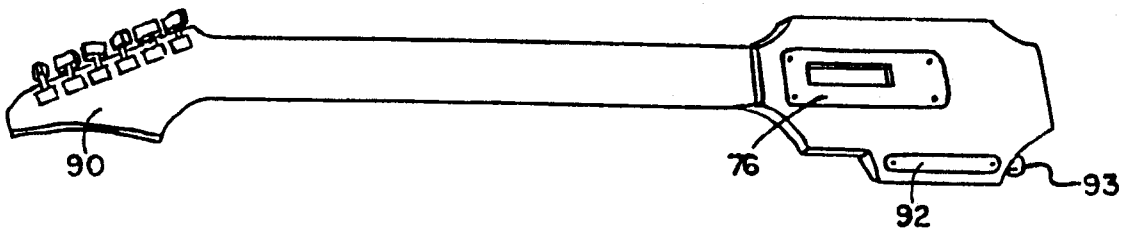
FIG. 5 shows an electric guitar module with a slotted backplate which acts as a female connecting apparatus to hold the module to a standard guitar.
Figure 6:
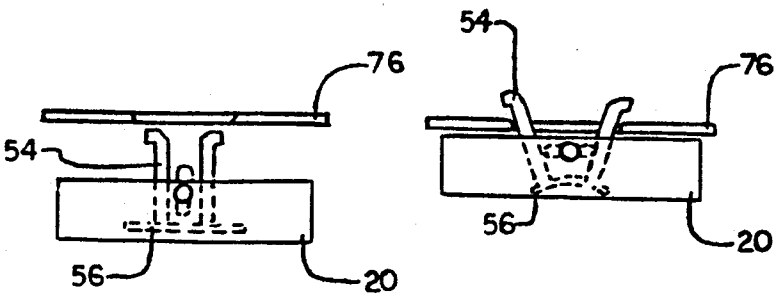
FIG. 6 shows two similar end views of a holding device and two expanding plates in unlocked and locked positions which secure the slotted backplate of the external module.

FIG. 5 shows the slotted backplate 76 of the external guitar module 90 and such common guitar features as an electronics cover 92 and an output jack 93. The importance of this is actually demonstrated in FIG. 6, which provides two illustrations of the expanding plates 54 with bent edges: one showing an unlocked position, prior to their insertion into the slotted backplate 76, and the other showing a locked position where they secure the slotted backplate 76. The expanding plates 54 are connected from beneath the cam-shaft 50 (from FIG. 2) by flexible means 56, such as a rubber holder or a metal hinge.

Figure 7:
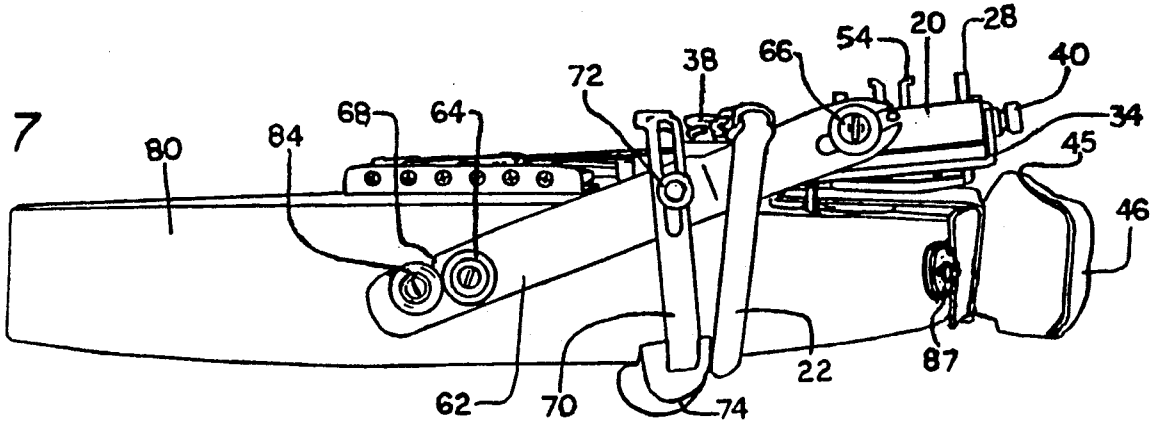
FIG. 7 shows a posterior end view of a standard guitar and a retrofit system attached from a posterior strap-fastening anchor.

The posterior view of the guitar 80 in FIG. 7 shows the rear connections of the retrofit system in a larger perspective. The strap-fastening anchors 84 and 64, the stabilizing bar 62, and the cross-bar 70 are of particular importance. The keyhole slot 68 is shown with the inserted strap-fastening anchor 84, which creates a need for the replacement anchor 64. Also, from this perspective, the channels for adjustment of both bars 62 and 70 can be seen clearly. The cross-bar 72 uses a locking thumb screw 72 to brace the guitar 80 with a padded end 74. The stabilizing bar 62 uses a locking screw 66 to correct and stabilize the horizontal angle of the retrofit encasement 20 to maintain a generally parallel relationship with the guitar 80.

OTHER EMBODIMENTS

Figure 8:
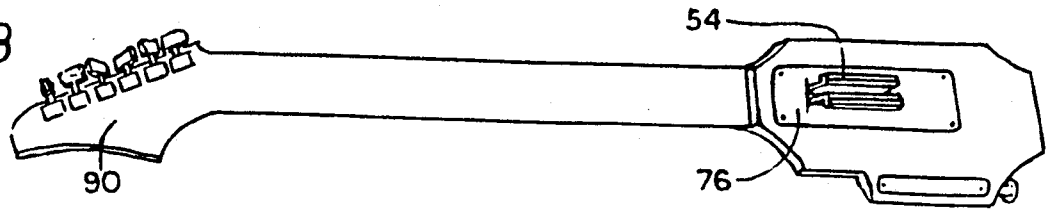
FIG. 8 shows an external guitar module in which a slotted backplate holds two integral expanding plates to engage the holding device.
Figure 9:
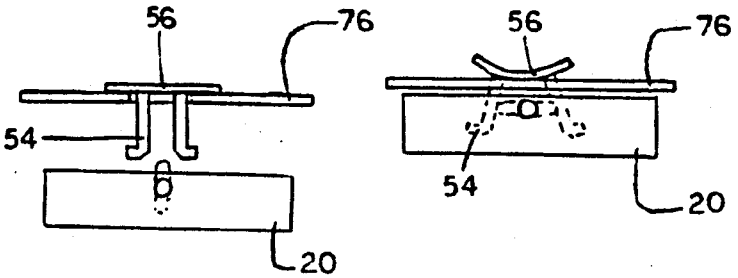
FIG. 9 shows two similar end views that demonstrate unlocked and locked positions of the two integral expanding plates on the slotted backplate which engage the holding device.
Figure 10:
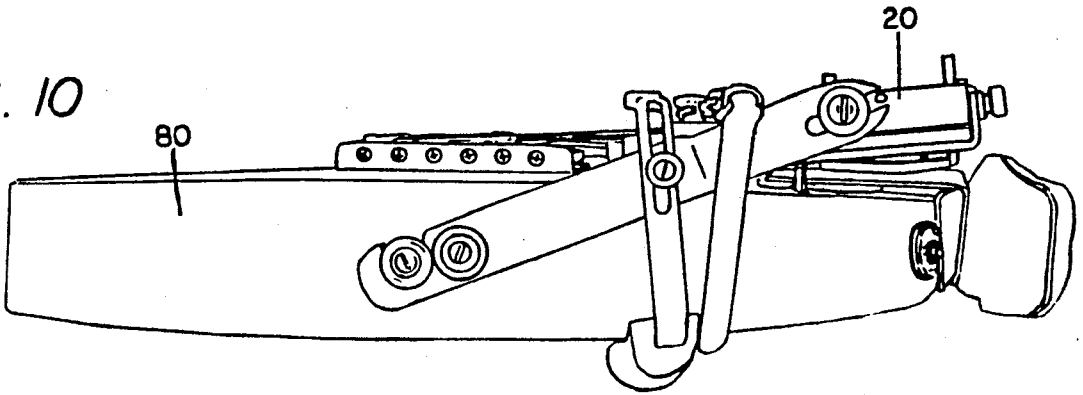
FIG. 10 shows a variation of FIG. 7 minus two expanding plates which are attached to the external module.

The remaining FIGS. 8 through 15 show variations of the retrofit system that may be needed for such purposes as adding special components, accommodating non-standard instruments, or streamlining the production process. FIGS. 8 and 9 show the expanding plates 54 as they would be applied if attached to the slotted backplate 76 of the external guitar module 90. FIG. 10 simply shows the retrofit encasement 20 without these parts. This variation might be used to adapt the external module 90 to components that would make it easier to play by itself, although both instruments are generally independent of each other.

Figure 13:
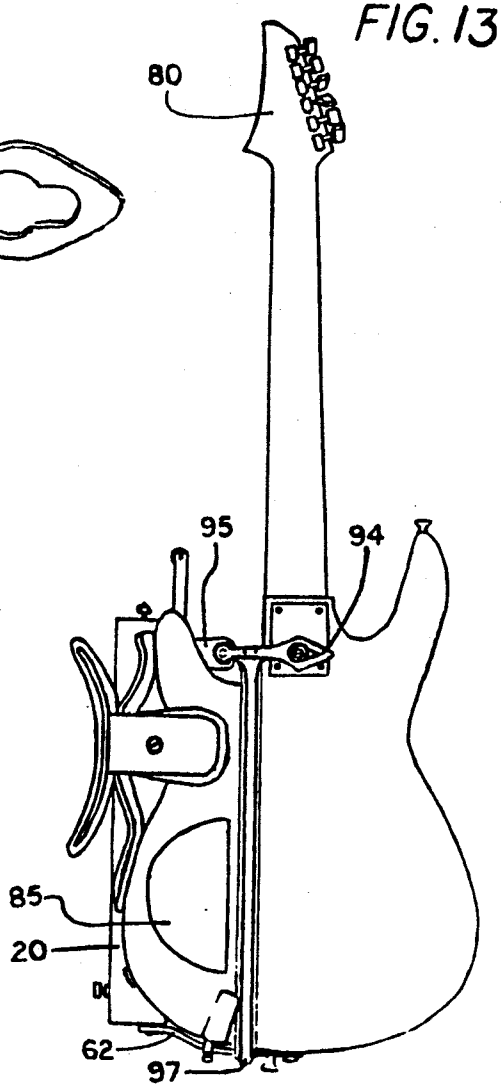
FIG. 13 shows the rear of the standard guitar in FIG. 11 with a cushioned connecting bar that attaches to the anterior stabilizing bar.
Figure 12:
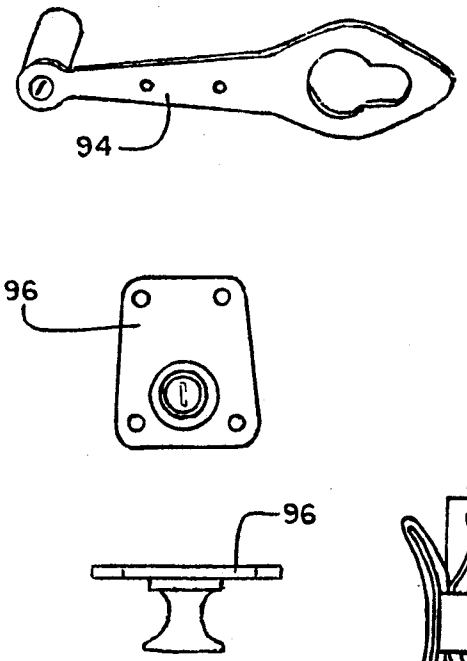
FIG. 12 shows enlarged views of the anterior stabilizing bar and a modified backplate with an anchoring facility.
Figure 11:
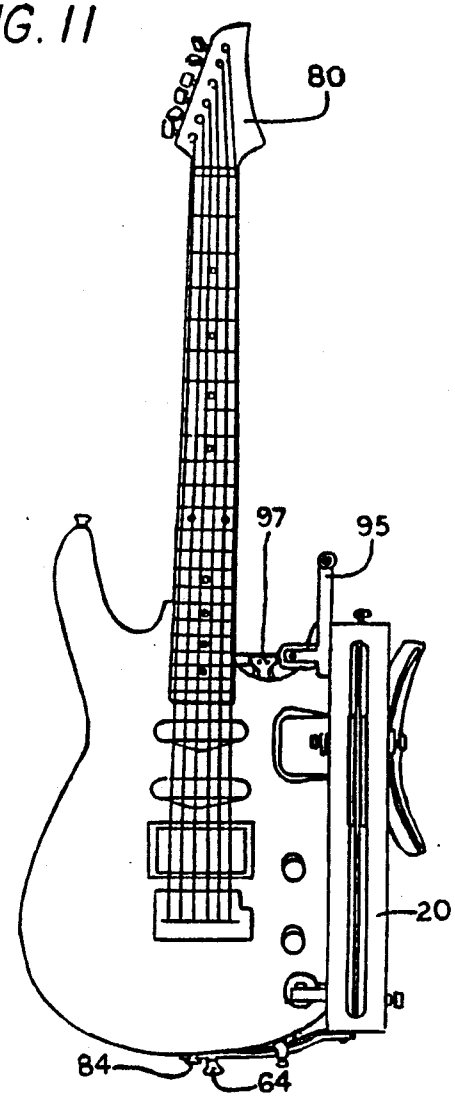
FIG. 11 shows the front of a standard guitar, a retrofit, and a modified strap - anchor holder attached to a rear mounted, anterior stabilizing bar at the body's horn-shaped cutaway.

Many commercial guitars do not have standard features and may therefore be unable to support the retrofit system in its most accessible embodiment. FIGS. 11, 12, and 13 illustrate a modified system that would be useful on guitars that have odd shaped curvatures, or which lack a lower horn-shaped cutaway section. On such instruments a bungee cord 22 would be ineffective because it needs an appropriately cutaway surface for support. To facilitate attachment of the system to these guitars, a special anchor must be used to support the anterior section.

An additional part is represented in FIG. 11 which replaces the bungee cord 22 connection of the previous illustrations. Here a modified strap anchor holder 95 has a perpendicular extension that attaches to an anterior stabilizing bar 94 (shown in FIG. 12). A new backplate with a spare anchor 96 replaces the standard backplate 79 (from FIG. 4) to provide the necessary support by securing the anterior stabilizing bar 94. For additional support, FIG. 13 illustrates a cushioned connecting bar 97 that extends along the back of the guitar 80 to connect both stabilizing bars (94 and 62) in place of the bungee cord 22.

Figure 15:
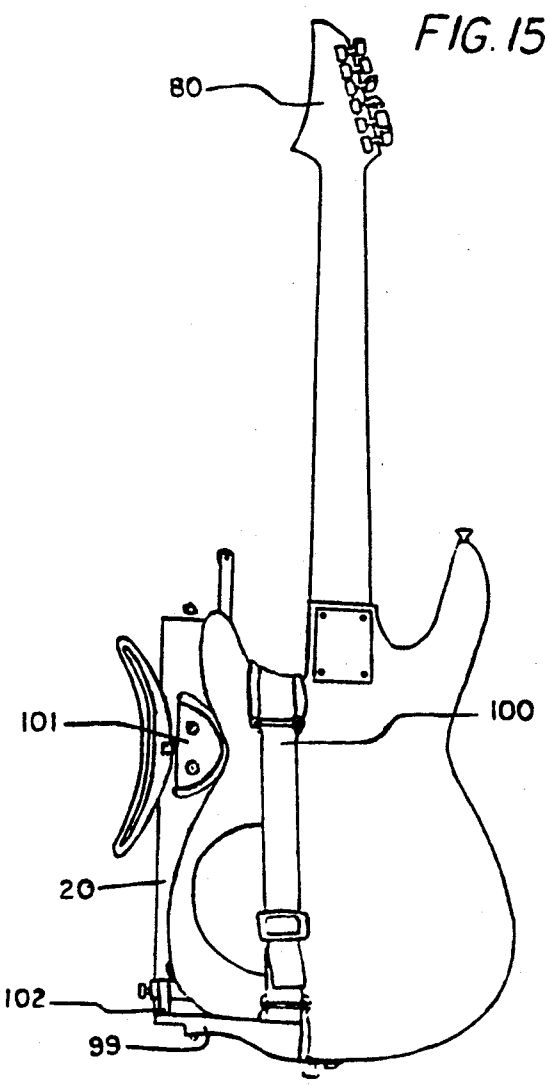
FIG. 15 shows the back of the standard guitar in FIG. 14 with a security connector, and a modified curvature extension unit.
Figure 14:
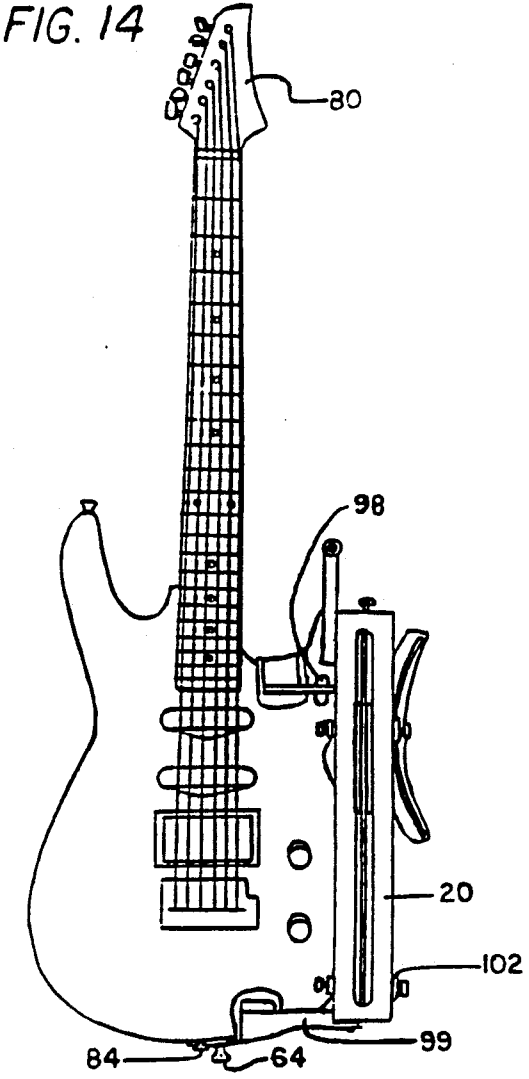
FIG. 14 shows the front of a standard guitar with a retrofit held in place by an external body brace.

To enhance the production of any device means to reduce the number of parts that must be manufactured. FIGS. 14 and 15 illustrate a retrofit system with fewer parts. In a die-cast or injection molded format, an advanced retrofit system would probably include an adjustable body brace 99 that would extend from the curvature extension unit. A new body expander 101 would also be integral with the unit, as well as a brace support 98. A security connector 100 would connect the brace, and angle corrections could be made from an adjusting receptacle 102.

Accordingly, the reader will see that the objectives described herein can be fulfilled by the present invention. The retrofit system combines a standard electric guitar or bass with an external four, six, or twelve string guitar module or travel guitar in a detachable format that does not alter the standard instrument in any way. It provides double-neck capabilities for picking and strumming with the additional ability to facilitate simultaneous two-hand playing styles, wherein each hand plays its own instrument. This retains the feeling and playability of a full-sized, single-neck guitar and provides a detachable means of relieving the unbalanced weight associated with double-necks.

Although specific details are used to outline a preferred embodiment of this invention, its scope should not be limited to the above description, particularly since alternate parts may be needed to adapt to non-standard commercial instruments. For example, a smaller guitar may only provide enough space to mount a stationary shaft between its anchoring points (instead of the larger retrofit encasement), thereby necessitating the use of a different sliding lock. Odd-shaped modules may also need different backplates. Thus the scope of this invention should not be confined to the details of any embodiment, but instead should be determined by the appended claims and their legal equivalents.

What is claimed is:

1. An accessory for mounting a second stringed instrument onto a first stringed instrument; wherein said first stringed instrument comprises a body having a strap-fastening anchor on one end and a horn-shaped cutaway section on an opposite end thereof, comprising:

a rectangular holding device elongated along an axis;

means for detachably mounting an locking said second stringed instrument onto said holding device; wherein said mounting and locking means comprises a means for slidably moving the second stringed instrument along the axis;

means for detachably securing the holding device to the first stringed instrument; wherein said securing means comprises a strap-fastening means for attaching the holding device both to the strap-fastening anchor and the horn-shaped cutaway of said first stringed instrument.

2. An accessory according to claim 1 comprising:

said mounting sand locking means further comprises a backplate;

said backplate being attachable to said second stringed instrument.

3. An accessory according to claim 2 comprising:

a curvature extension means for supporting said holding device against a user attached to said holding device.

4. An accessory according to claim 1 comprising:

a curvature extension means for supporting said holding device against a user attached to said holding device.

* * * * *